US005630703A

United States Patent [19]

Hendley et al.

[11] Patent Number: 5,630,703

[45] Date of Patent: May 20, 1997

[54] ROTOR DISK POST COOLING SYSTEM

[75] Inventors: David G. Hendley, Wyoming; Steve R. Fledderjohn, West Chester; Randall C. Bauer, Hamilton; Jonathon P. Clarke, West Chester; Alan L. Webb, Mason, all of Ohio

[73] Assignee: General Electric Company, Cincinnati, Ohio

[21] Appl. No.: 573,317

[22] Filed: Dec. 15, 1995

[51] Int. Cl.[6] ..... F01D 05/08

[52] U.S. Cl. ..... 416/95; 416/220 R

[58] Field of Search ..... 416/95, 96 R, 416/97, 190, 193 A, 220 R, 219 R; 415/115, 116

[56] References Cited

U.S. PATENT DOCUMENTS

| | | | |
|---|---|---|---|
| 2,873,947 | 2/1959 | Perry | 253/77 |
| 3,318,573 | 5/1967 | Matsuki et al. | 253/39.15 |
| 3,635,586 | 1/1972 | Kent et al. | 416/97 |
| 3,709,631 | 1/1973 | Karstensen et al. | 416/95 |
| 3,768,924 | 10/1973 | Corsmeier et al. | 416/95 |
| 3,834,831 | 9/1974 | Mitchell | 416/95 |
| 4,111,603 | 9/1978 | Stahl | 416/95 |
| 4,457,668 | 7/1984 | Hallinger | 416/95 |
| 4,659,285 | 4/1987 | Kalogeros et al. | 416/95 |
| 4,820,116 | 4/1989 | Hovan | 416/95 |
| 4,884,950 | 12/1989 | Brodell et al. | 416/95 |
| 4,890,981 | 1/1990 | Corsmeier et al. | 416/95 |
| 5,173,024 | 12/1992 | Mouchel et al. | 416/95 |
| 5,201,849 | 4/1993 | Chambers et al. | 416/95 |
| 5,281,097 | 1/1994 | Wilson et al. | 416/193 |
| 5,318,404 | 6/1994 | Carreno et al. | 416/95 |
| 5,339,619 | 8/1994 | Antonellis | 416/95 |
| 5,388,962 | 2/1995 | Wygle et al. | 416/95 |

*Primary Examiner*—Edward K. Look
*Assistant Examiner*—Mark Sgantzos
*Attorney, Agent, or Firm*—Andrew C. Hess; Wayne O. Traynham

[57] ABSTRACT

A cooling system for use in a rotor assembly of a gas turbine engine, the rotor assembly including an annular disk rotatable about a centerline axis of the engine and a plurality of blades mounted on the disk. The disk includes alternating posts and slots, with each slot receiving a blade dovetail. The cooling system comprises an axially extending plenum disposed inward of each blade dovetail and a thermal isolation chamber, formed by a seal body, disposed over the outer surface of each disk post. An annular forward blade retainer is attached to the disk and sealed with adjacent structures via inner and outer seals. Alternative structures are disclosed for diverting the cooling air from the plenums, past the inner and outer seals, and into the isolation chambers during operation of the engine so as to cool each disk point, without compromising the structural integrity of the forward blade retainer. The cooling system further includes an aft retention member forming in part an annular plenum in fluid flow communication with each of the axially extending plenums. The annular plenum is further in fluid flow communication with a plurality of passages formed between disk post and blade dovetail relief surfaces, with air flowing through these passages effective for further cooling the disk posts. The air flowing through at least a portion of these passages is subsequently directed to the thermal is isolation chambers.

28 Claims, 6 Drawing Sheets

ROTOR DISK POST COOLING SYSTEM

BACKGROUND OF THE INVENTION 1.0 Field of the Invention

The present invention relates generally to gas turbine engines, and more particularly, to a system for cooling rotor disk posts, such as turbine rotor disk posts, of gas turbine engines.

2.0 Related Art

The highest temperatures in gas turbine engines are typically found in the combustor and the turbines. For instance, it is not uncommon for the temperature of the primary gas stream of the engine to exceed 2400° F. at the entrance to the first stage blade of the high pressure turbine. The continuing demand for larger and more efficient gas turbine engines creates a requirement for increased turbine operating temperatures, with the metallurgical limitations of critical components such as rotor blades and disks in opposition to this requirement. For example, nickel-based alloys are commonly used in the manufacture of turbine rotor disks, with such alloys typically limited to maximum metal temperatures of approximately 1100° F., which is considerably less than the maximum possible primary gas path temperature in the turbine. Consequently, there is a continuing need for novel approaches to provide thermal protection for components such as turbine rotor disks.

A turbine rotor disk is an annular component which rotates about the longitudinal axis of the engine and which supports a plurality of blades that extend radially into the primary gas stream. The disk typically includes a plurality of circumferentially alternating dovetail slots and posts disposed about the periphery of the disk, with each post formed by adjacent ones of the slots. Each disk dovetail slot is adapted to receive a corresponding dovetail portion, also referred to as a "fir tree" portion of a blade, with the blades being actually loaded into the disk. In addition to the dovetail portion, each blade includes a shank portion attached to and extending radially outward from the dovetail portion and a plate-like platform which radially separates the shank portion flora an airfoil portion of the blade extending radially into the primary gas stream flowpath. The outer surface of the blade platforms form a portion of the radially inner boundary of the primary gas stream flowpath, with the platform portions of adjacent stationary structures, such as nozzle segments, forming the remainder of the inner boundary. The Background Section of U.S. Pat. No. 5,388,962 issued to Wygle, et al., which is assigned to the assignee of the present invention and is expressly incorporated by reference herein in its entirety, provides a discussion of the need to cool the blades with conventional means such as compressor discharge air and further provides a discussion of the heat balance which determines the temperature of the disk posts. Wygle, et al. further explains that thermal isolation of the top of the disk posts from the hot air mixture existing in the cavity surrounding each disk post is an important part of the overall system for ensuring that the temperature of the disk posts do not exceed allowable limits.

As further explained in Wygle, et al., a known system to provide such disk post isolation has included shields located at the radially inward side of the blade platforms such that each shield spans the gap between platforms of adjacent blades to discourage ingestion of flowpath gases. This known system further includes cooling holes through the shank portions of the blade which communicate with the blade interior cooling passages in order to purge the cavities between the shanks of adjacent blades over each disk post.

However, as noted in Wygle, et al., this system has the disadvantage of placing the holes in a highly stressed region of the blades, with the stress concentrations associated with the holes creating the potential for cracking and premature failure of the blades. This system has a further disadvantage due to the requirement of purging the relatively large cavities formed between shanks of adjacent blades and bounded at an outer end by the blade platforms and at an inner end by the top of one of the disk posts, which results in the use of a relatively high amount of compressor discharge cooling air and the associated engine performance penalty. Another disadvantage of this system is that the air injected into the cavities over the disk posts via the blade shank holes is significantly colder than the metal of the surrounding structures, particularly the blade platforms. As the colder "heavier" air is injected into the cavities it is subject to rotational effects. Centrifugal forces push the air radially outward so as to essentially bypass the disk posts. Accordingly, very little disk post cooling is accomplished. After the cavity cooling air is forced outward, radial recirculation occurs due to buoyancy forces caused by contact between the relatively hot blade platforms and the relatively cooler blade shank injected air. The disk posts are then washed, or scrubbed, by cavity cooling air which is at a much higher temperature than the cooling air flowing through the blade interior cooling passages, due to the contact of the cooling air with the blade platforms.

Also as noted in Wygle, et at., another known disk post isolation system has included the use of a structure commonly known as a seal body such as seal body assembly 28 illustrated in U.S. Pat. No. 5,201,849 issued to Chambers, et al., which is assigned to the assignee of the present invention and is expressly incorporated by reference herein in its entirety. Each seal body 28 of Chambers, et al. includes an aperture 32 in a forward end plate 36 opening into a diffusing hole 48 which is used to slowly drift forward cavity air over the top or radially outer surface of the corresponding disk post 24 so as to form an insulative layer of air over the disk post 24. However, as noted in Wygle, et al., this system is sensitive to manufacturing tolerances regarding the geometry of diffuser hole 48. If the geometry is not adequately controlled, the velocity of the forward cavity air passing over the outer surface of the disk post 24 may be unacceptably high, which may actually result in the temperature of the disk post 24 rising due to the associated convection heating from the forward cavity air.

The cooling system illustrated in FIGS. 3–5 of Wygle, et at., was developed to overcome the problems of the aforementioned known disk post thermal isolation systems. The Wygle, et al. system includes a seal body 31' positioned over the outer surface of each disk post 20. Each of the seal bodies includes a hole 176 formed through a forward portion of the seal body 31' for purposes of directing diverted blade cooling air onto an outer surface 33 of each disk post 20. The Wygle, et al. system further includes an annular blade retainer 48', having an increased radial height which may be seen by comparing retainer 48' in FIG. 3 of Wygle, et al. to retainer 48 illustrated in FIG. 1 of Wygle, et al. Blade retainer 48' is sealed at an inner end by seal 66 and at an outer end by seal 60 so as to prevent undesirable ingestion of gases from forward cavity 134 between the retainer 48' and the blade dovetail portions 24 and disk posts 20, and to prevent undesirable leakage of blade cooling air from plenums 94. It is noted that outer seal 60 is disposed radially outward of hole 176 formed through seal body 31'. During operation of engine 10, the blade cooling air is diverted from plenums 94 through slots 150 formed in each blade dovetail portion 24, so as to bypass inner seal 66, and is directed into plenum 160, formed in part by blade retainer 48'. The diverted cooling air then enters hole 176 and is directed across the top, or outer surface 33 of each disk post 20.

While the cooling system disclosed in FIGS. 3–5 of Wygle, et al. represents an improvement over previously existing known disk post thermal isolation systems, it is subject to the following disadvantages. The previously discussed increase in the radial height of the blade retainer 48' results in the radially outer end of the retainer 48' being closer to the hot gases of flowpath 32. Accordingly, it is more difficult to design a retainer 48' which will meet creep requirements due to the increased temperature of the outer end of the retainer 48' relative to prior retainers having a reduced radial height, such as retainer 48 illustrated in FIG. 1 of Wygle, et al.. Additionally, the increased height of retainer 48' results in an increased mass which in turn results in increased centrifugal forces acting on retainer 48' and an increase in bending stress in the fillet radius, indicated generally at E in FIG. 1 of the subject application, which is a partial reproduction of FIG. 3 of Wygle, et al., at the foot of the arm of retainer 48'. A further disadvantage of the Wygle, et al. cooling system is that the cooling air loses static pressure as it passes through each hole 176, prior to entering the corresponding thermal isolation chamber 144. This energy loss reduces the ability of the cooling air to adequately purge the thermal isolation chambers 144 so as to prevent ingestion of any hot air which may have scrubbed the underside of the blade platforms and exists in the cavities surrounding the seal bodies 31'.

In view of the foregoing, prior to the subject invention a need existed for a cooling system in a rotor assembly of a gas turbine engine to cool the top of rotor disk posts without compromising the structural integrity of the annular blade retainer used in the associated rotor assembly.

SUMMARY OF THE INVENTION

Accordingly, the present invention is directed for use in a rotor assembly of a gas turbine engine, with the rotor assembly including an annular disk rotatable about a centerline axis of the engine and a plurality of radially extending blades mounted on the disk. The disk includes a plurality of circumferentially alternating posts and slots disposed about a periphery of the disk. Each of the slots receive a dovetail portion of one of the blades. The cooling system is effective for cooling each of the disk posts and, according to a preferred embodiment of the present invention, comprises a plurality of seal bodies each forming a thermal isolation chamber positioned over a radially outer surface of one of the disk posts. The cooling system further includes a plurality of axially extending plenums, with each plenum positioned radially inward of the dovetail portion of one of the blades. The axially extending plenums receive cooling air during operation of the engine. The system further comprises a first, annular retention member attached to the disk at a radially inner end thereof, with the retention member being effective for preventing egress of the blades from the disk slob in one axial direction. A radially outer end of the first retention member is disposed proximate a first axially facing surface of a cover plate of each seal body. This system further includes a radially inner seal disposed in sealing engagement with the retention member, the dovetail portions of the blades and the disk posts, and a radially outer seal disposed in sealing engagement with at least the retention member and the cover plate of the seal bodies. The cooling system further includes a radially extending recess formed in a second, opposite axially facing surface of the cover plate of each of the seal bodies. Each of the recesses receives cooling air from at least one of the plenums, with the cooling air being diverted past the inner and outer seals, during operation of the engine. Each of the recesses is also in fluid flow communication with one of the thermal isolation chambers.

BRIEF DESCRIPTION OF THE DRAWINGS

The structural features and functions of the present invention will become more apparent from the following detailed description of the preferred embodiments when taken in conjunction with the accompanying drawings in which.

DETAILED DESCRIPTION

Figure 1:
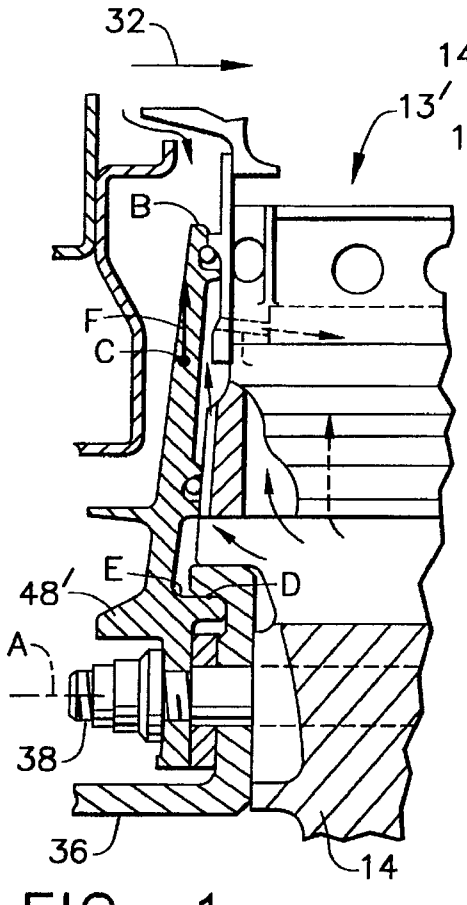
FIG. 1 (PRIOR ART)
FIG. 1 is a partial reproduction of the prior art disk post thermal isolation system illustrated in FIG. 3 of U.S. Pat. No. 5,388,962.
Figure 3:
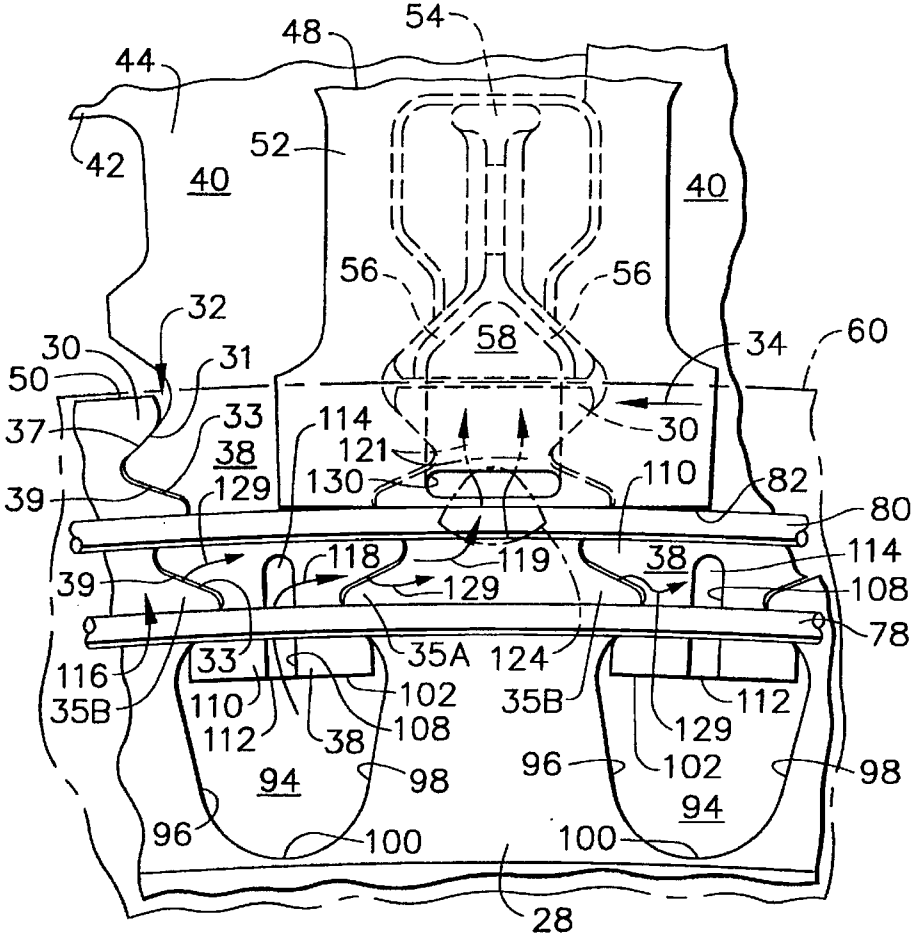
FIG. 3 is an enlarged axial view taken along line 3—3 in FIG. 2.

FIG. 1 is a partial reproduction of FIG. 3 from U.S. Pat. No. 5,388,962 issued to Wygle, et al. depicting a prior art rotor assembly 13' and the included disk post cooling system. As discussed in Wygle, et al. assembly 13' includes an annular blade retainer 48', comprising a stage one forward blade retainer, which is attached to disk 14 via bolts 38 and the associated nuts. The radial height of blade retainer 48', or the radial distance between axis A extending through the center of attachment bolts 38 and the outer tip of retainer 48' indicated generally at B, is greater than the radial height of prior blade retainers such as retainer 48 illustrated in FIG. 1 of Wygle, et al. The increase in mass of retainer 48', associated with the increase in radial height of retainer 48', causes the centrifugal forces F acting through the center of mass C to be larger than the corresponding centrifugal forces acting on prior retainers such as retainer 48 shown in FIG. 1 of Wygle, et al. Additionally, the axial distance between the center of mass C and pivot point D, which lies on a surface of retainer 48' which engages a forwardly extending flange on rotor shaft 36 in a rabbet fit, is greater than the corresponding distance on prior art retainer 48. Point D may be considered to lie on the centerline of action of retainer 48'. Due to the combination of increased centrifugal forces F and the increased axial distance between points C and D, as compared to the corresponding forces and axial distance regarding retainer 48 and similar prior art retainers, retainer 48' experiences an increased bending moment and the associated bending stress in a fillet radius E, as compared to the bending stress existing at similar locations of prior retainers having reduced radial heights. Additionally, since point B is radially closer to the primary gas path 32, the radially outer end of retainer 48' may be significantly hotter than the outer end of prior forward retainers having reduced radial heights. Due to the foregoing disadvantages associated with the increased radial height of retainer 48', retainer 48' may experience a reduced service life relative to prior stage one forward blade retainers having a reduced radial height.

Figure 2:
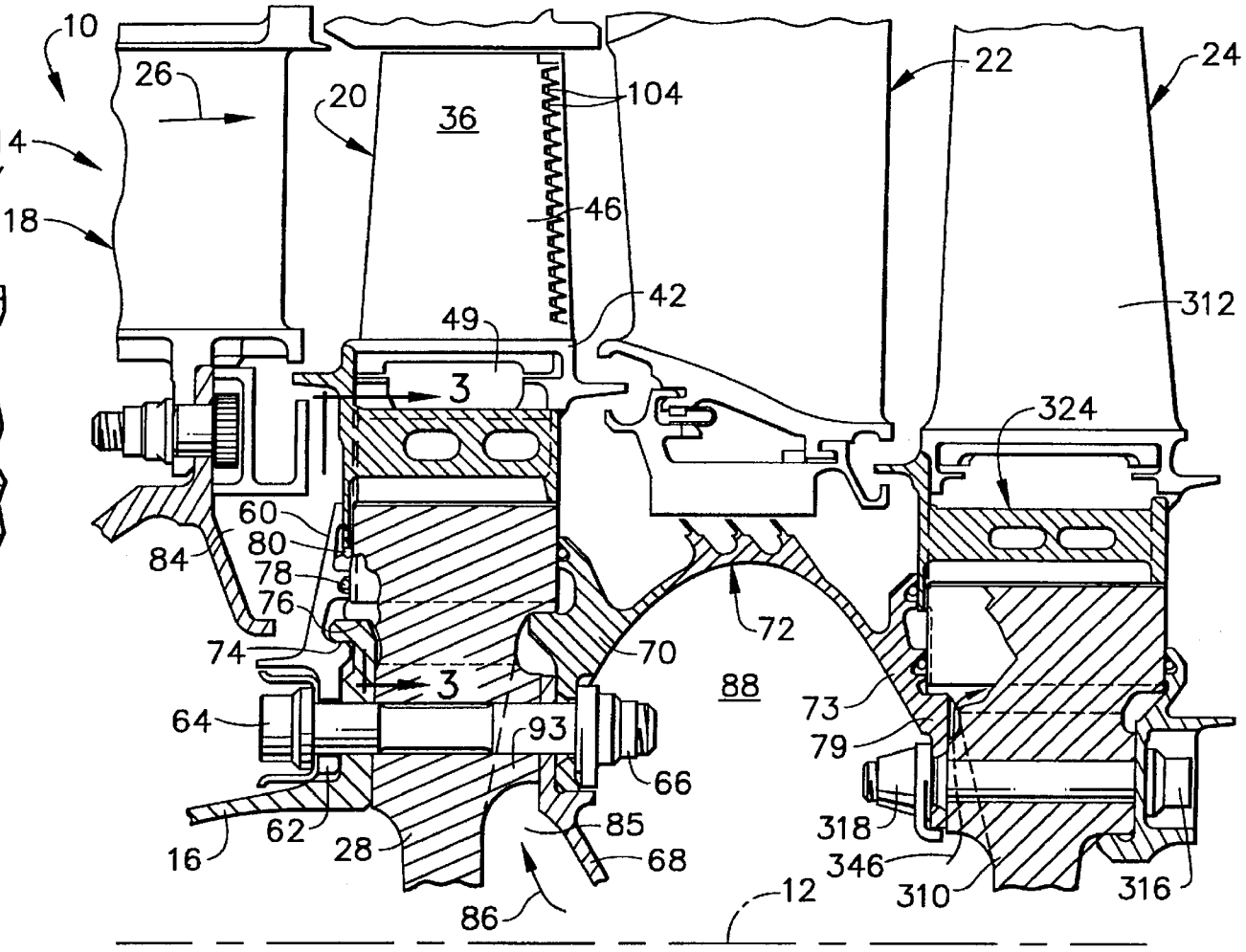
FIG. 2 is a fragmentary cross-section, taken along an engine longitudinal axis, illustrating a high pressure turbine of a gas turbine engine, with the high pressure turbine including stage 1 and stage 2 rotor assemblies which each may incorporate the cooling system of the present invention.

Referring now to FIGS. 2–10 of the drawings, FIG. 2 illustrates a fragmentary axial cross-section of an exemplary gas turbine engine 10 taken along a longitudinal centerline axis 12 of engine 10. The engine 13 includes, in serial axial flow communication about axis 12, conventional components including a fan, booster, high pressure compressor, combustor (all not shown), high pressure turbine 14, and a low pressure turbine (also not shown). High pressure turbine 14 is drivingly connected to the high pressure compressor with a first rotor shaft 16 and the low pressure turbine is drivingly connected to both the booster and the fan with a second rotor shaft (not shown). High pressure turbine 14 includes, in axial succession from front to aft, a stage one nozzle assembly indicated generally at 18, a stage one rotor assembly indicated generally at 20, a stage two nozzle assembly indicated at generally 22, and a stage two rotor assembly indicated generally at 24. The stage one rotor assembly 20 and stage two rotor assembly 24 may each incorporate the disk post cooling system according to the present invention.

The compressed air exiting the high pressure compressor of engine 10, commonly referred to as the primary or core gas stream, theft enters the combustor where the pressurized air is mixed with fuel and turned to provide a high energy gas stream 26 which enters high pressure turbine 14. However, prior to entering the combustor, a portion of the primary or core gas flow may be diverted to provide a source of cooling air for various high temperature components, including, but not limited to, various elements of the stage one rotor assembly 20 and stage two rotor assembly 24. The cooling air may be routed to high pressure turbine 14 in a conventional manner and used for subsequently described purposes. Alternatively, cooling air may be provided to high pressure turbine 14 from a source other than the air discharging the high pressure compressor of engine 10.

Referring now to FIGS. 3–6, the particular construction of the stage one rotor assembly 20 and the included disk post cooling system according to a preferred embodiment of the present invention, is discussed in greater detail. Rotor assembly 20 includes an annular disk 28 rotatable about the centerline axis 12 of engine 10. Disk 28 includes a plurality of circumferentially alternating posts 30 and slots 32 disposed about a periphery 34 of disk 28. Assembly 20 further includes a plurality of radially extending blades 36 mounted on the disk 28. Each disk slot 32 receives a dovetail portion 38 of one of the blade 36. In the illustrative embodiment, disk slots 32 and blade dovetail portions 38 are shown to 30 have a characteristic fir tree shape, although other forms of blade to disk interlocking, which are known in the art, may be utilized. Blades 36 are axially loaded into the axially extending disk slots 32. Due to the fir tree shape, each blade dovetail portion 38 includes a plurality of pressure faces, or contact surfaces 37 formed on each of the opposing, circumferentially facing sides of dovetail portion 38 and a plurality of relief surfaces 39 formed on each of the circumferentially facing sides of dovetail portion 38. Similarly, each disk post 30 includes a plurality of contact surfaces 31 and a plurality of relief surfaces 33 formed on each opposing, circumferentially facing side of disk post 30. During operation of engine 10, centrifugal force urges blades 36 radially outward so that the contact surfaces 37 of each blade dovetail portion 38 is forced into contacting engagement with adjacent ones of the disk post contact surfaces 31, while relatively small gaps, or passages, are created between each relief surface 39 of blade dovetail portion 38 and an adjacent one the disk post relief surfaces 33. The disk post cooling system of the present invention advantageously utilizes the passages between adjacent ones of relief surfaces 39 and 33 as subsequently discussed. Each blade 36 further includes a shank portion 40, attached to and extending radially outward of dovetail portion 38, a platform portion 42 attached to an outer end 44 of shank portion 40, and an airfoil portion a 46 attached to and extending radially outward from platform portion 42 into that primary gas path 26 (as shown in FIG. 2).

Figure 5:
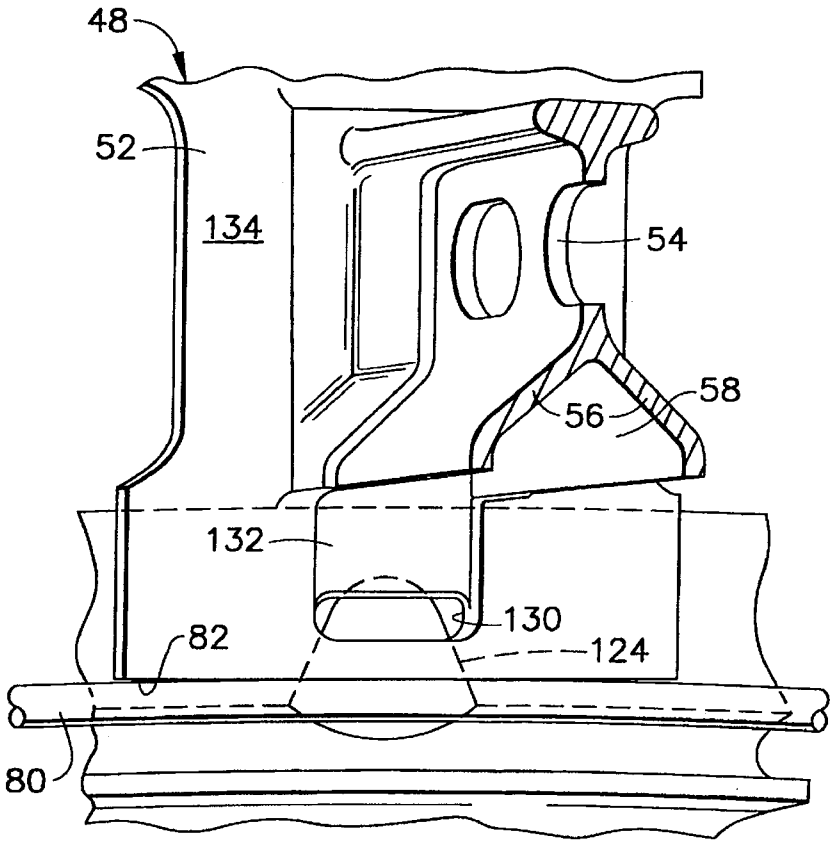
FIG. 5 is a perspective view of the stage 1 rotor assembly seal body illustrated in FIGS. 2–4.

Rotor assembly 20 further includes a plurality of seal bodies 48, with each seal body 48 positioned in a cavity 49 (shown in FIG. 2) bounded by a radially outer surface 50 of one of the disk posts 30, the shank portions 40 of an adjacent pair of blades 36, and the platform portions 42 of the adjacent blades 36. As best seen in FIG. 5, which illustrates seal body 48 according to a preferred embodiment, each seal body 48 includes a cover plate 52, comprising afterward cover plate, and an axially extending connecting member 54 attached to cover plate 52. Connecting member 54 includes a pair of radially inwardly extending legs 56 which define a thermal isolation chamber 58. The thermal isolation chamber 58 of each seal body 48 is positioned over the radially outer surface 50 of one of the disk posts 30.

Rotor assembly 20 further includes an annular retention member 60, comprising a forward blade retainer, coaxially disposed with disk 28 about centerline axis 12. Blade retainer 60 is attached, at an inner end 62, to disk 28 by conventional means such as a plurality of circumferentially spaced bolts 64 and nuts 66 (only one each shown). Bolts 64 and nuts 66 are also effective for attaching shaft 16, an annular spacer 68, and a forward portion 70 of an annular thermal shield 72, to disk 28. It is noted that in certain applications, spacer 68 may be replaced by an annular spacer/impeller, as known in the art. As shown in FIG. 2, shaft 16 is sandwiched axially between retainer 60 and disk 28, and spacer 68 is sandwiched axially between disk 28 and thermal shield 72. The required concentricity among shaft 16, blade retainer 60 and disk 28 is provided by rabbet fits between the mating surfaces of shaft 16 and retainer 60, is indicated generally at 74, and the mating surfaces between shaft 16 and disk 28 is indicated generally at 76. Blade retainer 60 is effective for preventing egress of blades 36 from disk slots 32 in an axially forward direction. The forward portion 70 of thermal shield 72 comprises an annular retention member and is effective far preventing the egress of blades 36 from disk slots 32 in an axially aft direction.

Rotor assembly 20 further includes a forward, radially inner seal 78 which is disposed in sealing engagement with blade retainer 60, the dovetail portion 38 of each of the blades 36, and each of the disk posts 30. A forward, radially outer seal 80 is disposed in sealing engagement with blade retainer 60, the forward cover plate 52 of each of the seal bodies 48, the dovetail portion 38 of each blade 36, and each of the disk posts 30. Assembly 20 further includes an aft seal 81 disposed in sealing engagement with an outer end 83 of the forward portion 70 of thermal shield 72, and in sealing engagement with disk posts 30 and the dovetail portion 38 of each blade 36. Seals 78, 80 and 81 preferably comprise seal wires having a generally circular cross-section, and are effective far subsequently described purposes. As best seen in FIG. 3, the forward outer seal 80 is disposed in sealing engagement with a radially inner edge 82 of the forward cover plate 52 of each seal body 48. The radial height of the forward portion 70 of thermal shield 72 is increased relative to that of prior thermal shields such that the outer end 83 extends farther radially outward from the centerline of attachment bolts 64. Seal 81 is disposed radially outward of the forward, inner seal 78 and the forward portion 70 is configured so as to partially form an annular plenum 75 between the forward portion 70 and an aft surface of each disk post 30 and an aft surface of the dovetail portion 38 of each blade 36. The existence of plenum 75 and the relative radial positioning of seals 78 and 81 are effective for cooling an inner portion of each disk post 30 as subsequently described.

During operation of engine 10 cooling air is routed to high pressure turbine 14 from a source which may include but is not limited to the high pressure compressor of the engine 10, for purposes of cooling various elements of high pressure turbine 14. Typically, this cooling air is routed axially aftward from the high pressure compressor of engine 10 to high pressure turbine 14 in a conventional manner, with a portion used to purge a cavity 14 formed by elements of the stage one nozzle assembly 18, with cavity 84 being disposed axially forward of the stage one rotor assembly 20. Another portion of the cooling air supplied by the compressor passes inward of the bore (not shown) of disk 28 and into a channel 85 formed by the aft side of disk 28 and a forward side of spacer 68 as depicted by flow arrow 86. Yet another portion of the cooling air flows through holes (not shown) formed in an inner portion of spacer 68 and into a chamber 88, formed in part by thermal shield 72, for purposes of cooling elements of the stage two rotor assembly 24. The cooling air entering cavity 85 flows radially outward with the cooling air then flowing circumferentially beneath aft embossments 93 of disk 28 and then radially outward between circumferentially adjacent ones of embossments 93 into each of a plurality of axially extending plenums 94. Each plenum 94 is defined by opposing sides 96 and 98 of adjacent disk posts 30, a contoured disk slot bottom 100 which interconnects opposing sides 96 and 98, and a radially inward surface 102 of the dovetail portion 38 of the blade 36 disposed in the corresponding slot 32. A portion of the cooling air entering each plenum 94 is directed into internal cooling passages (not shown) of the corresponding blade 36 for the purpose of cooling the corresponding blade 36. The cooling air entering the internal blade cooling passages may exit into the primary gas flowpath 26 through a variety of passages such as film holes and tip cap holes (not shown) and trailing edge holes 104 in a manner known in the art. For further illustration of the manner in which the cooling air may enter the axially extending plenums disposed inward of each blade, as well as the internal flow passages in each blade, the reader may refer to U.S. Pat. No. 5,388,962. Forward inner seal 78, outer seal 80 and aft seal 81 are effective for preventing an undesirable, uncontrolled leakage of the cooling air from the axially extending plenums 94. As taught in U.S. Pat. No. 5,388,962, the cooling air existing in the axially extending plenums 94 may be effectively used for cooling the top, or radially outer surface 50 of each of the disk posts 30. However, due to the reduced radial height of blade retainer 60, relative to retainer 48' of U.S. Pat. No. 5,388,962, as well as the positioning of seals 78 and 80 of the present invention, any cooling air diverted from plenums 94 of the present invention to thermal isolation chambers 58 must be diverted past both inner seal 78 and outer seal 80, unlike the cooling system included in U.S. Pat. No. 5,388,962. The diversion of cooling air from plenums 94 to chambers 58 is accomplished by the novel features of the present invention. In addition to cooling each disk post 30 with air diverted to the top of each post 30, additional cooling of the inner portion of each disk post 30 is accomplished by the novel features of the present invention, as subsequently discussed.

Each blade 36 includes a radially extending slot 108 formed in a forward, axially facing surface 110 of the dovetail portion 38, with slots 108 facing blade retainer 60. Each slot 108 has an entrance 112 disposed radially inward of the inner seal 78, and adjacent to and in fluid flow communication with one of the plenums 94. Each slot 108 further includes an exit, or outer portion 114 which is disposed radially outward of the inner seal 78 and in fluid flow communication with an annular channel 116 which is bounded at a radially outer end by the outer seal 80 as shown in FIG. 3, where blade retainer 60 is illustrated in phantom for clarity. Accordingly, slots 108 are effective for diverting cooling air from corresponding ones of the axially extending plenums 94 past inner seal 78 into channel 116, as shown by flow arrow 118, during operation of the engine 10. Due to the rotation of the elements of rotor assembly 20, the air entering channel 116 typically flows in one circumferential direction only. Channel 116 is further defined by an annular lip 120 of blade retainer 60 (shown in FIG. 4), an axially aftward facing surface 122 of retainer 60, the axially forward facing surface 110 of each dovetail portion 38, and an axially forward facing surface of each disk post 30. Blade retainer 60 includes a plurality of circumferentially spaced scallops 124 (only one shown in phantom in FIG. 3), which are formed in the axially aftward facing surface 122 of retainer 60.

Figure 4:
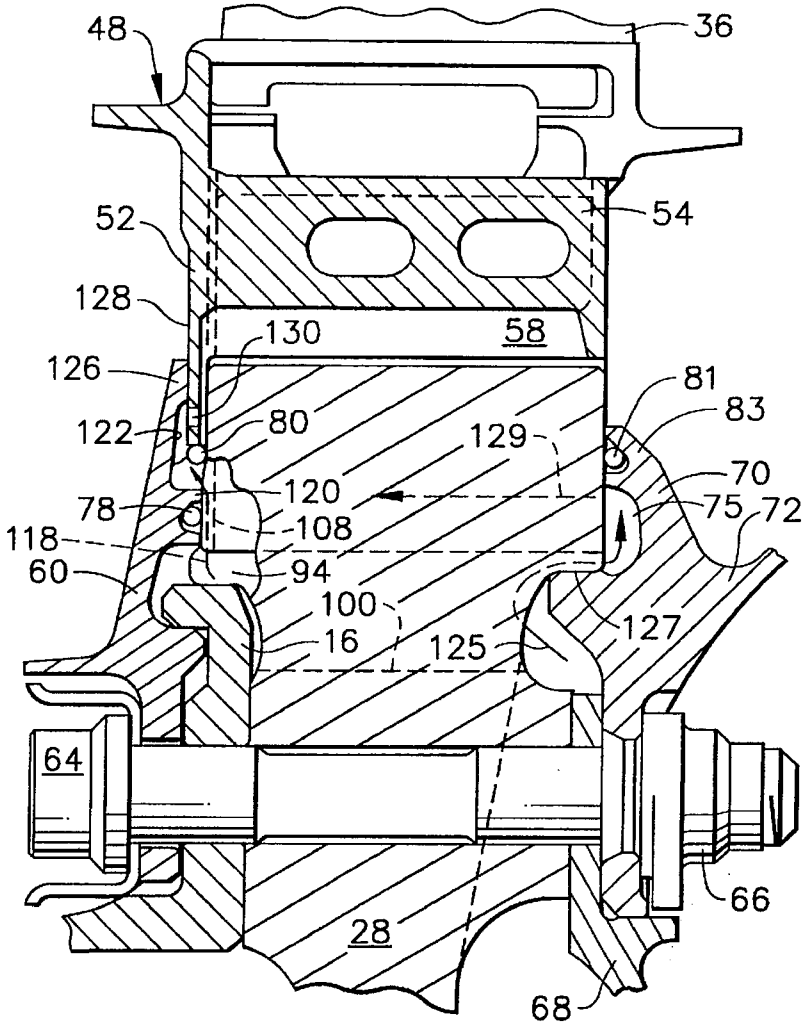
FIG. 4 is an enlarged cross-sectional view illustrating a portion of the stage rotor assembly shown in FIG. 2.

In addition to the air flowing from plenums 94 through slots 108 and into channel 116 as indicated by flow arrow 118, cooling air is also diverted from each plenum 94 to the annular plenum 75 disposed between the forward portion 70 of thermal shield 72 and the aft surface of each disk post 30 and blade dovetail portion 38, as depicted by flow arrow 125 in FIG. 4. As shown in FIG. 4, the forward portion 70 of thermal shield 72 engages disk 28 in the rabbet fit as indicated generally at 127. However, the rabbet fit existing at 127 is interrupted circumferentially due to the presence of blades 36 in slots 52 of disk 28. Accordingly, the cooling air is free to flow from the axially extending plenums 94 to the annular plenum 75, along path 125, at each circumferential location where the rabbet fit 127 does not exist As explained previously, during operation of engine 10 relatively small gaps, or passages, are created between each of the blade dovetail relief surfaces 33 and adjacent ones of the disk post relief surfaces 39. Due to the radial extent of plenum 75 and the relative radial positioning of aft seal 81 and forward inner seal 78, the air flowing through plenum 75 is in fluid flow communication with the inner ones of these passages and flows axially forward through each inner passage and then circumferentially into channel 116, as depicted by flowpath arrow 129 in FIGS. 3 and 4. Accordingly, the cooling air flowing along path 129 may be used twice. First, as the air flows axially through the passages between surfaces 33 and 39, is effective for cooling an inner tang 35A and an inner tang 35B of each disk post 30. Secondly, this cooling air is ultimately effective for cooling the top of each disk post 3C since it joins the cooling air entering channel 116 from blade slots 108. The radial distance of aft seal 81 from engine axis 12 is approximately the same as the radial distance from axis 12 to forward outer seal 80. Accordingly, plenum 75 is not in fluid flow communication with the passages formed between outer pairs of surfaces 33 and 39, as may be appreciated from FIG. 3.

A radially outer end 126 of blade retainer 60 is disposed proximate a forward, axially facing surface 128 of cover plate 52 of each seal body 48. End 126 may preferably contact or abut each surface 128. Each seal body 48 further includes an aperture 130 extending axially through the forward cover plate 52. In the embodiment illustrated in FIG. 5, aperture 130 comprises an enclosed, circumferentially elongated slot. Each seal body 48 further includes a radially extending recess 132 formed in an aft, axially facing surface 134 formed in cover plate 52. Each slot 130 is in fluid flow communication with a corresponding recess 132 and slot 130 and recess 132 are generally radially aligned with one another. Slot 130 and recess 132 are generally centrally disposed circumferentially with respect to the forward cover plate 52, which in turn is generally symmetrically disposed circumferentially about the connecting member 54 of seal body 48. Accordingly, slot 130 and recess 132 are generally radially aligned with a corresponding one of the thermal isolation chambers 58. The number of seal bodies 48, and accordingly the number of slots 130 and recesses 132, is equal to the number of scallops 124 formed in blade, retainer 60, and the slot 130 and recess 132 of each seal body 48 is generally radially aligned, or positioned at the same general circumferential location, with one of the scallops 124. As best seen in FIG. 3, each scallop 124 radially spans the outer seal 80, with an inner portion of each scallop 124 disposed radially inward of the outer seal 80 and an outer portion of each scallop 124 disposed radially outward of the outer seal 80. Additionally, the radial distance from the engine centerline 12 to each scallop 124 is selected so that scallops 24 radially overlap corresponding ones of slots 130, as shown in FIG. 3. Accordingly, each scallop 124 is in fluid flow communication with channel 116 and with a generally radially aligned one of the slots 130 and recesses 132. During the operation of engine 10, the air flowing circumferentially through channel 116 flows radially into and through each of the scallops 124, then axially through each slot 130 and radially through each recess 132, as depicted by flow arrows 119 and 121 and into each of the thermal isolation chambers 58 so as to cool each disk post 30. Accordingly, scallops 124 are effective for diverting the cooling air from channel 116 past outer seal 80 into slots 130, recesses 132 and chambers 58. During operation of engine 10 centrifugal force acting on seal body 48 creates a small radial gap between an inner surface of legs 56 of each seal body 48 and the corresponding disk post 30, thereby permitting the cooling air to exit each chamber 58 into a corresponding one of cavities 49.

Figure 6:
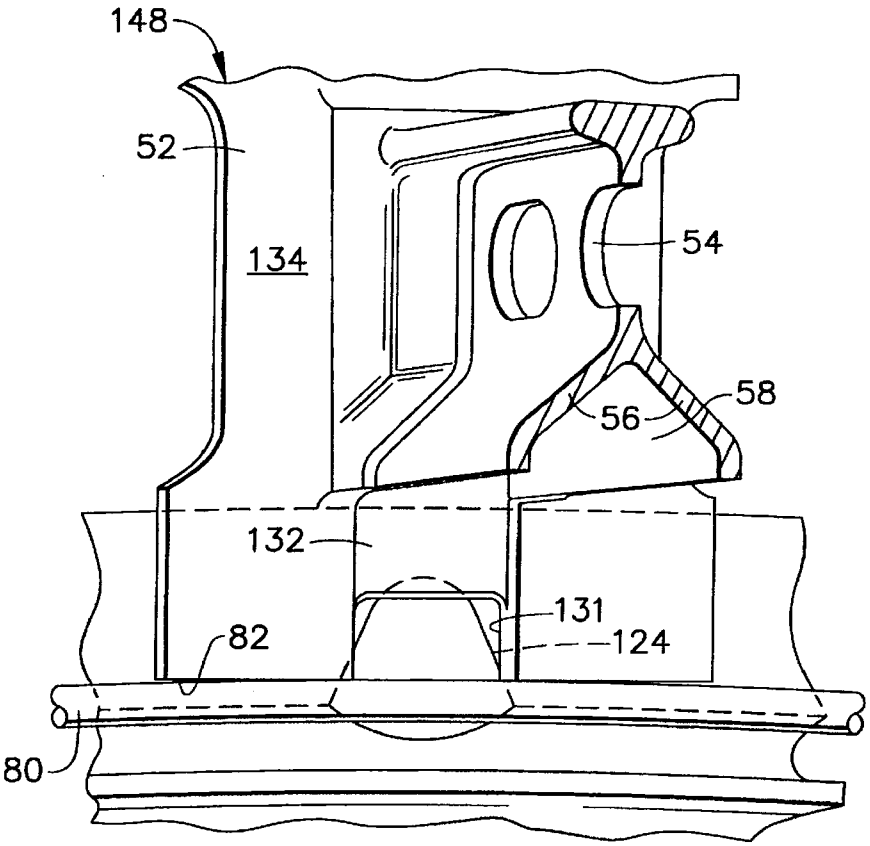
FIG. 6 is a perspective view illustrating a seal body according to an alternative embodiment which may be incorporated in the stage 1 rotor assembly cooling system depicted in FIGS. 2–4.

FIG. 6 illustrates a seal body 148 according to an alternative embodiment, which may be incorporated in the stage one rotor assembly 20 in lieu of each seal body 48. Seal body 148 is identical to seal body 48 with the exception that the enclosed slot 130 extending through forward cover plate 52 of seal body 48 is replaced by an aperture, comprising an open slot 131 extending axially through the forward cover plate 52 of seal body 148 and extending radially to inner edge 82 of plate 52. The seal body 148 functions in the same manner as seal body 48 with respect to conveying cooling air from scallop 124 axially through slot 131, then radially through recess 132 and into thermal isolation chamber 58. One potential disadvantage with seal body 148 is that with certain applications the outer seal 80 may eventually creep locally into one or more of the open slots 131, thereby restricting the flow of cooling air to the corresponding thermal isolation chamber 58.

Figure 7:
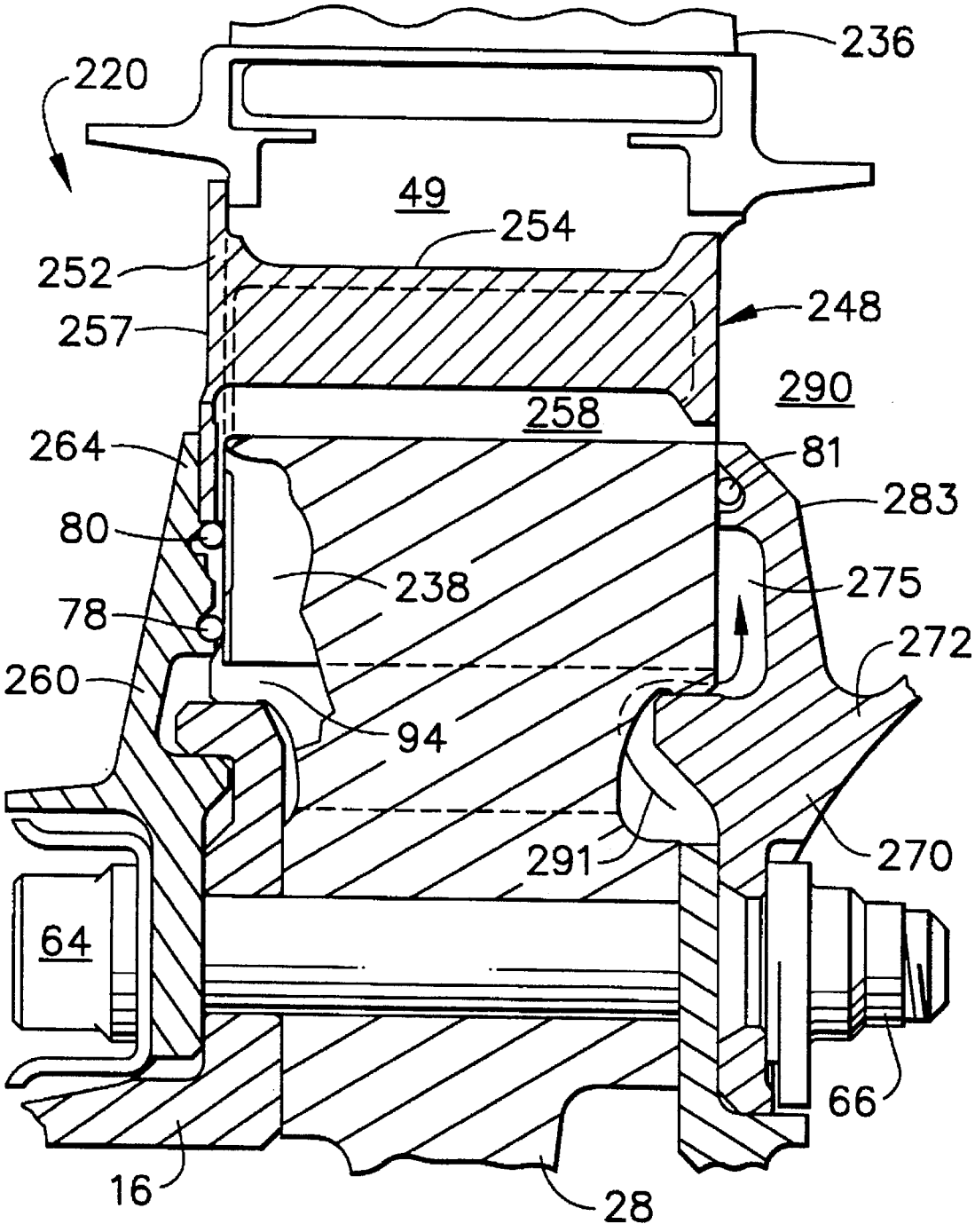
FIG. 7 is an enlarged, partial cross-sectional view, similar to FIG. 4, illustrating a stage I rotor assembly incorporating the cooling system of the present invention according to an alternative embodiment.
Figure 8:
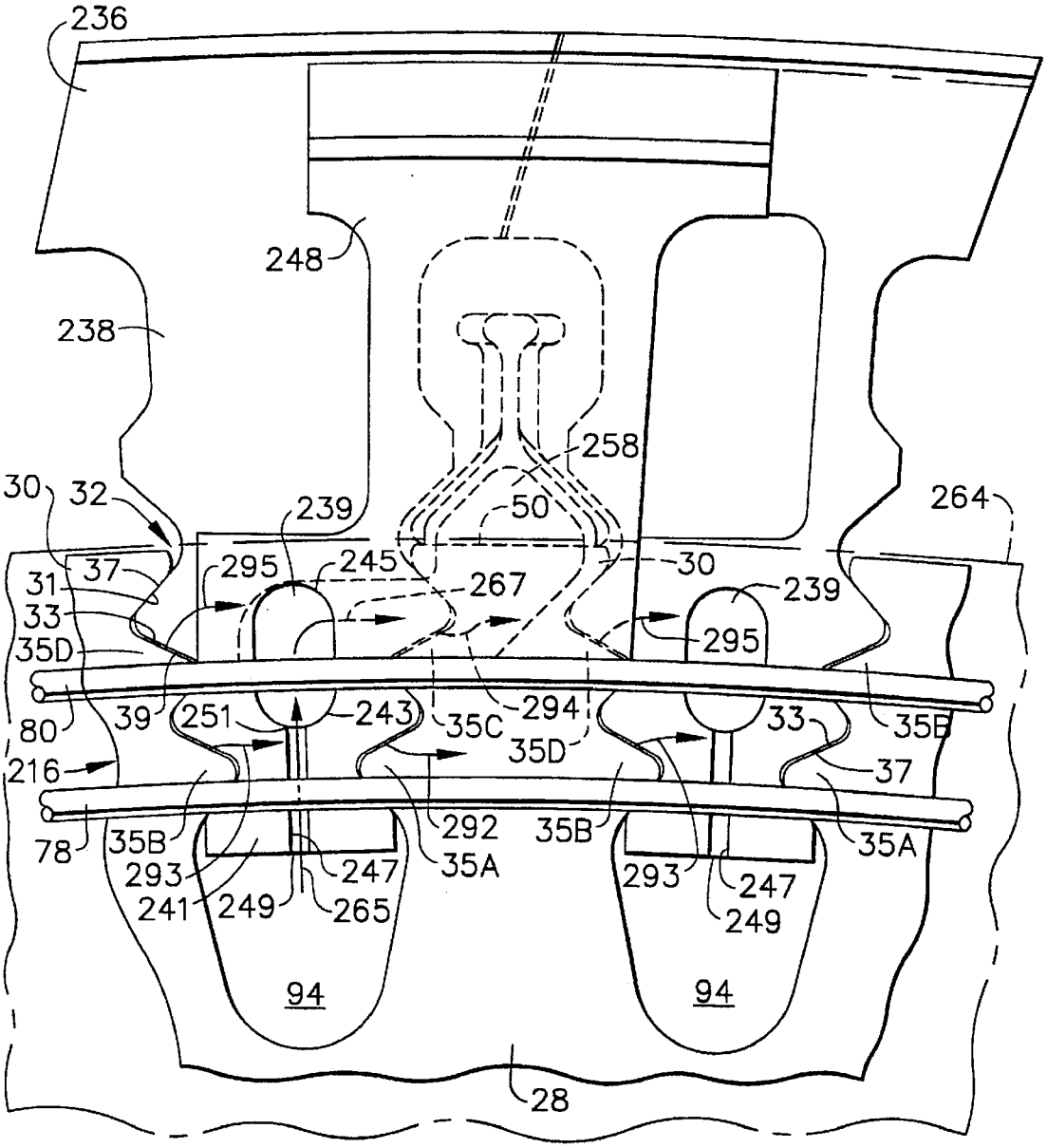
FIG. 8 is an axial view, taken in a forward looking aft direction, further illustrating the cooling system shown in FIG. 7.
Figure 9:
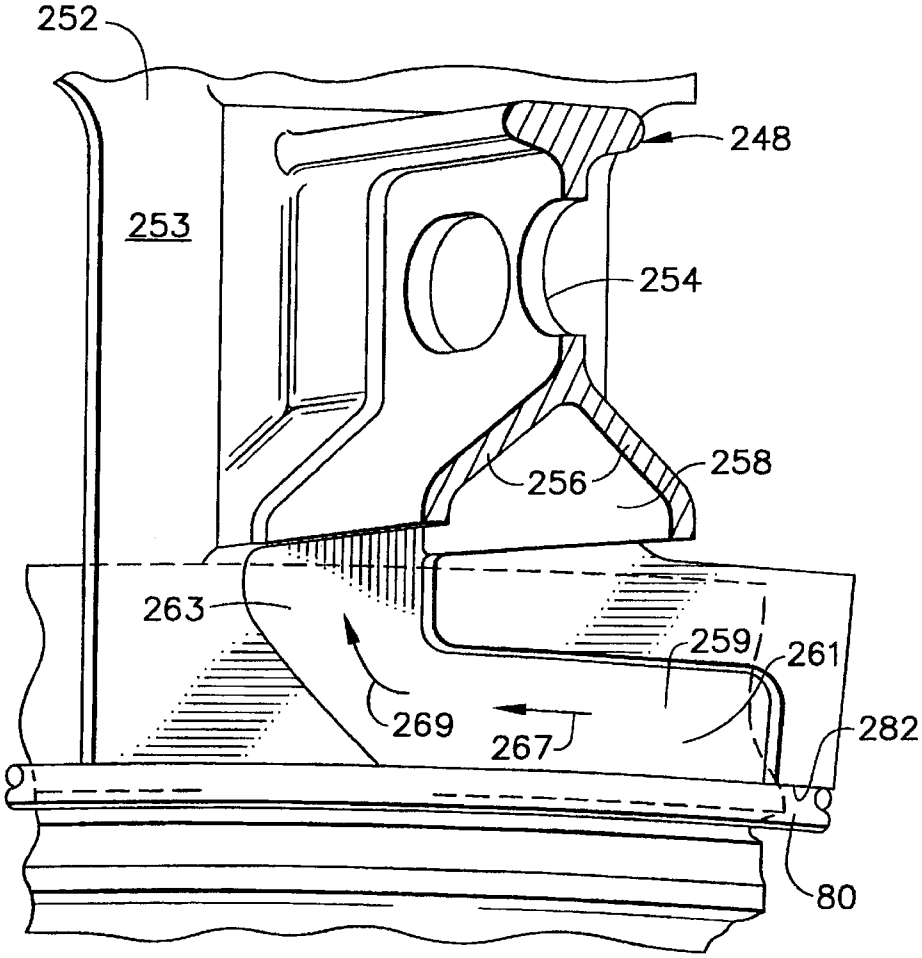
FIG. 9 is a perspective view illustrating the seal body incorporated in the cooling system depicted in FIGS. 7–8.

Referring now to FIGS. 7–9, an alternative rotor assembly 220 of the high pressure turbine 14 is illustrated, wherein assembly 220 incorporates the disk post cooling system of the present invention according to an alternative embodiment. Assembly 220 is structurally the same as assembly 20, with the following exceptions. Blades 36, blade retainer 60 and seal bodies 48 of assembly 20 are replaced with blades 236, blade retainer 260 and seal bodies 248, respectively, in assembly 220. Unlike retainer 60, blade retainer 260 does not include scallops formed in an aft surface thereof. Accordingly, alternative means are provided for diverting the cooling air past the forward outer seal 80. Blades 236 are structurally the same as blades 36, with the exception that dovetail portion 238 of each blade 236 includes a cavity 239 formed in a forward, axially facing surface 241 of dovetail portion 238. Each cavity has a radially inner end 243 disposed radially inward of the forward outer seal 80 and a radially outer end 245 disposed radially outward of the forward outer seal 80. Similar to blades 36, the dovetail portion 238 of each blade 236 includes a radially extending slot 247 formed in the axially facing surface 241 of the dovetail portion 238, so that slots 247 face forward blade retainer 260. Each slot 247 has an entrance 249 disposed radially inward of the inner seal 78 and in fluid flow communication with one of the axially extending plenums 94. Each slot 247 further includes an exit which intersects, and is therefore in fluid flow communication with, the corresponding cavity 239. As shown in FIG. 8, slots 247 and cavities 239 are radially aligned with one another. Each seal body 248 includes a forward cover plate 252 and an axially extending connecting member 254 attached to cover plate 252. Connecting member 254 includes a pair of radially inwardly extending legs 256 which define a thermal isolation chamber 258, disposed over the radially outer surface 50 of one of the posts 30 of disk 28. Each seal body 248 further includes a recess 259 formed in an aft, axially facing surface 253 of cover plate 252. As shown in FIG. 9, cover plate 252 is asymmetrically disposed circumferentially about connecting member 254 so as to accommodate the particular configuration of recess 259 which includes a first, circumferentially extending entrance portion 261 and a second, radially extending exit portion 263. The entrance portion 261 of each recess 259 is in fluid flow communication with one of the cavities 239 formed in the dovetail portion 238 of each blade 236. The exit portion 263 of each recess is in fluid flow communication with the thermal isolation chamber 258 of the corresponding seal body 248. As shown in FIG. 7, an outer end 264 of the blade retainer 260 is proximate, and preferably abuts or contacts, a forward, axially facing surface 257 of cover plate 252 and the forward outer seal 80 is disposed in sealing engagement with a radially inner edge 282 of the forward cover plate 252, similar to the positioning of seal 80 in rotor assembly 20.

Although rotor assembly 220 may be used in conjunction with thermal shield 72, as described previously with respect to rotor assembly 20, assembly 220 may alternatively be used in conjunction with a thermal shield 272 having a forward portion 270 with an increased radial height relative to the forward portion 70 of thermal shield 72, so that an outer end 283 of the forward portion 270 generally coincides with an outermost portion of each disk post 30, as shown in FIG. 7. Seal 81 is disposed in sealing engagement with the forward portion 270 and an aft surface of each disk post 30 and an aft surface of the dovetail portion 238 of each blade 236. Due to the increased radial height of forward portion 270 of thermal shield 272, the entire aft surface of each disk pest 30 is shielded from hot gases existing in an interstage cavity 290 disposed outward of thermal shield 272 and adjacent an interstage seal of nozzle assembly 22 (not shown in FIG. 7). Like blades 36, blades 236 include a plurality of contact surfaces 37 and a plurality of relief surfaces 39 formed on each of the circumferentially facing sides of dovetail portions 238. In addition to thermally shielding the entire aft surface of each disk post 30, the increased radial height of the forward portion 270 of thermal shield of 272 creates an annular plenum 275 having a radial height greater than the corresponding plenum 75 of rotor assembly 20, so its to permit cooling air to flow through additional, radially outer ones of the passages between dovetail relief surfaces 39 and disk post relief surfaces 33, as subsequently described, which is not possible if thermal shield 72 is used.

During operation of engine 10, the axially extending plenums 94 receive cooling air, as described previously with respect to the stage one rotor assembly 20. A portion of the cooling air then flows radially outward from plenums 94 through each of the slots 247, as depicted by flow arrow 265, past the inner seal 78 and into the corresponding cavities 239. Accordingly, slots 247 are effective for diverting cooling air from the plenums 94 past the inner seal 78. The cooling air then flows radially outward through cavities 239, past the outer seal 80, and into the entrance portion 261 of each recess 259 where the cooling air flows circumferentially as depicted by flow arrow 267. The cooling air then turns again and flows radially through the exit portion 263 of each recess 259, as depicted by flow arrow 269, into the corresponding ones of the thermal isolation chambers 258 so as to cool each disk post 30. Accordingly, cavities 239 are effective for diverting the cooling air past the outer seal 80 into corresponding ones of the recesses 259 and chambers 258. The cooling air may exit each chamber 258 into the corresponding one of the cavities 49 in which seal body 248 is disposed, as described previously with respect to seal bodies 48 and chambers 58.

Additionally, during operation of engine 10, a portion of the air from the axially extending plenums 94 flows radially outward past the interrupted rabbet fit between the forward portion 270 of thermal shield 272 and disk 28, and into the annular plenum 275 as depicted by flow arrow 291 (shown in FIG. 7). Plenum 275 is in fluid flow communication with the passages formed between each dovetail relief surface 39 and the opposing, or adjacent disk post relief surface 33. In the embodiment illustrated in FIGS. 7 and 8, each disk post 30 includes four relief surfaces 33, with one of the surfaces 33 included in each of the dovetail tangs designated as 35A, 35B, 35C and 35D in FIG. 8. However, it should be understood that disk posts 30, and dovetail portions 38 may include other numbers of tangs. Accordingly, each of the tangs 35A, 35B, 35C and 35D of each disk post 30 are cooled by cooling air passing axially through the gaps, or passages formed between the corresponding disk post relief surface 33 and the adjacent dovetail portion relief surface 39, as indicated by flowpath arrows 292, 293, 294 and 295, respectively. The cooling air flowing along each path 294 is in direct fluid flow communication with one of the recesses 259 formed in the forward cover plate 253 of seal body 248, and is therefore directed to one of the thermal isolation chambers 258 for cooling the corresponding disk post 30. The cooling air flowing along each of the paths 292 and each of the paths 293 turns circumferentially into a channel 216 bounded radially by forward inner seal 78 and forward outer seal 80, and then into at least one of the cavities 239 formed in blade dovetail portions 238. Accordingly, this air is also directed to at least one thermal isolation chamber 258 for cooling the corresponding disk post 30. The cooling air flowing along each of the paths 295 is precluded from ultimately reaching one of the thermal isolation chambers 258 since it is blocked by the forward cover plate 253 of one of seal bodies 248.

Figure 10:
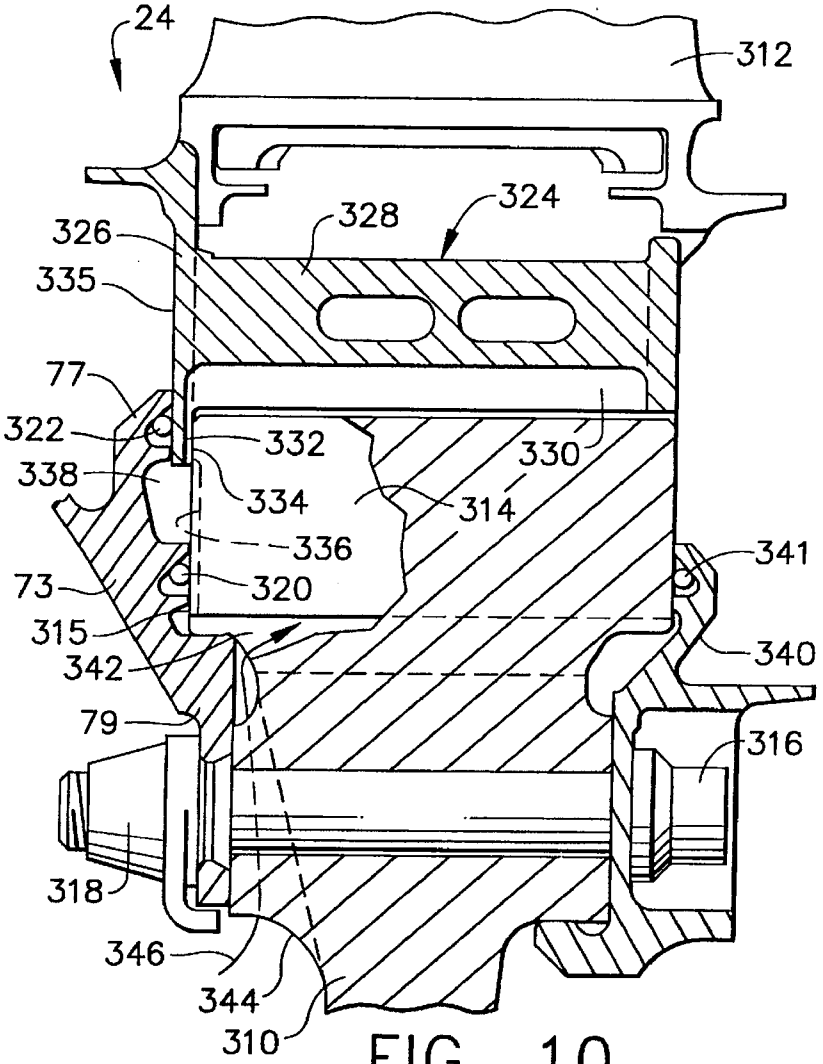
FIG. 10 is an enlarged, partial cross-sectional view illustrating the stage 2 rotor assembly and included cooling system shown in FIG. 2.

Referring now to FIG. 10, the stage two rotor assembly 24 and the included disk post cooling system according to an alternative embodiment of the present invention, is illustrated in greater detail. Rotor assembly 24 includes an annular disk 310 which is rotatable about the centerline axis 12 of engine 10, and a plurality of radially extending blades 312 (only one shown) mounted on the disk 310. Disk 310 includes a plurality of circumferentially alternating posts and slots, similar to disk 28, with each slot receiving a dovetail portion 314 of one of the blades 312. Blades 312 are axially loaded into the slots of disk 310. As shown in FIGS. 2 and 10, the thermal shield 72, which extends between the stage one disk 28 and the stage two disk 3 10, includes an aft portion 73 which is attached, at a radially inner end 79, to disk 310 by conventional means such as bolts 316 and anti-rotation nuts 318 (one each shown). The aft portion 73 of thermal shield 72 comprises an annular retention member, or blade retainer, which is effective for preventing egress of the blades 312 from the slots of disk 310 in an axially forward direction. Aft portion 73 is sealed at an inner end with an annular seal 320, and at an outer end by an annular seal 322. The inner seal 320 is disposed in sealing engagement with the aft portion 73 of thermal shield 72, the dovetail portions 314 of blades 312, and the posts of disk 310. An aft blade retainer 340 is attached at an inner end to disk 310 by conventional means such as bolt 316 and nuts 318 and is effective for preventing egress of the blades 312 from the slots of disk 310 in an axially aft direction. Aft blade retainer 340 is sealed at an outer end by an annular seal 341. Forward inner seal 320, forward outer seal 322 and aft seal 341 preferably comprise seal wires having a generally circular cross-section. Similar to rotor assembly 20, rotor assembly 24 includes a plurality of real bodies 324 with each seal body being positioned over one of the posts of disk 310. Each seal body 324 includes a forward cover plate 326 and an axially extending connecting member 328 attached to the cover plate 326. The connecting member 328 includes a pair of radially inwardly extending legs, similar to legs 56 of seal body 48 and legs 256 of seal body 248, which define a thermal isolation chamber 330. Each seal body 324 includes a radially extending recess 332 formed in an aft, axially facing surface 334 of cover plate 326.

The outer seal 322 is disposed in sealing engagement with a forward, axially facing surface 335 of cover plate 326. Outer seal 322 is retained within a notch formed in an outer end 77 of aft portion 73 of thermal shield 72 which is disposed proximate, but does not contact, surface 335 of cover plate 326. A small axial gap is formed between outer end 77 of aft portion 73 of thermal shield 72 and the forward cover plate 326 of each seal body 324 due to assembly and maintainability considerations which do not form a part of the present invention. The existence of the small axial gap between aft portion 73 and each cover plate 326 requires the forward outer seal 322 to be disposed in sealing engagement with the axially forwardly facing surface 335 of each cover plate 326, so as to prevent an unacceptable leakage of cooling air radially outward from an annular plenum 338. Accordingly, the forward outer seal 322 may not be disposed in sealing engagement with a radially inner edge of cover plate 326, as is the case with seal 80 and cover plate 52 of the stage 1 rotor assemblies 20 and 220. With the positioning of seal 322 in the stage 2 rotor assembly 24, art acceptably low leakage of cooling air will occur with the air flowing radially outward from plenum 338 between small radially extending gaps formed between opposing circumferentially facing edges of the cover plates 326 of each adjacent pair of seal bodies 324. This leakage does not occur in assemblies 20 and 220 due to the positioning of seal 80. In certain applications, depending upon assembly and maintainability considerations, an axial gap may not be required between the outer end 77 of aft portion 73 of thermal shield 72 and the forward cover plate 326 of each seal body 324. In these instances the stage two rotor assembly 24 may be configured to include a cooling system similar to one of the previously described cooling systems of the stage one rotor assemblies 20 and 220, at least with respect to the previously described manner in which cooling air is diverted from the plenums 94 of assemblies 20 and 220 to thermal isolation chambers 58 and 258, respectively, but not necessarily with respect to the disk post tang cooling achieved by the cooling systems of assemblies 20 and 220.

Each blade 312 includes a radially extending slot 336 formed in a forward, axially facing surface 315 of dovetail portion 314, which is in fluid flow communication with an axially extending plenum 342 positioned radially inward of dovetail portion 314 and defined by the radially inner surface of dovetail portion 314 and adjacent ones of the posts of disk 310 as described previously with respect to rotor assembly 20. Each slot 336 faces the aft portion, or retention member 73.

During operation of the engine 10, a portion of the cooling air entering high pressure turbine 14 passes through holes formed in spacer 68 and then into cavity 88, as discussed previously. The cooling air then flows radially outward between circumferentially adjacent ones of forward embodiments 344 of disk 310 and into the axially extending plenums 342 disposed inward of the dovetail portions 314 of blades 312 as depicted by flowpath arrow 346. The air then flows radially outward through slob 336, past the inner seal 320 into the annular plenum 338 which is formed in part by blade retainer 73, as well as the dovetail portion 314 of each blade 312 and the posts of disk 310. The cooling air then flows radially outward through each of the recesses 332, which are effective for diverting the cooling air past the outer seal 322, and into the thermal isolation chambers 330, where the cooling air is effective for cooling the posts of disk 3 10. The cooling air may exit each chamber 330 as described previously with respect to chambers 58 of assembly 20.

In operation each embodiment of the disk post cooling system of the present invention is effective for diverting cooling air from radially extending plenums positioned inward of the blade dovetail portions, past inner and outer seals in sealing engagement with a blade retention member, to thermal isolation chambers positioned over the outer surface of the disk posts for purposes of cooling the disk posts. In each embodiment this diversion of cooling air is accomplished without adversely effecting the structural integrity of the associated blade retention member. Additionally, the slots and/or recesses formed in the forward cover plate of the various seal bodies of the present invention substantially reduce the static pressure loss associated with the cover plate holes of prior seal bodies such as hole 176 in seal body 31' of U.S. Pat. No. 5,388,962.

While the foregoing description has set forth the preferred embodiments of the invention in particular detail, it must be understood that numerous modifications, substitutions and changes can be undertaken without departing from the true spirit and scope of the present invention as defined by the ensuing claims. For instance, although the cooling system of the present invention has been illustrated for use with various embodiments of bolted motor assemblies, the cooling system of the present invention may also be advantageously utilized with boltless rotors, i.e., those in which structures such as a blade retainer, turbine shaft, and thermal shield may be attached to the associated rotor disk by conventional means other than bolts and nuts. Such means of attachment may include, but are not limited to, bayonet-type locking rings, or split rings. Regardless of the method of attachment, anti-rotation features are provided to assure proper relative circumferential positioning of the various structures. Additionally, although the stage two rotor assembly 24 has been illustrated with a conventional aft blade retainer, it may also include a modified aft blade retainer having an increased radial height similar to the forward and aft portions of the illustrated thermal shield, so as to advantageously provide disk post tang cooling along the axially extending passages discussed previously. Further, the cooling system of the present invention may be advantageously utilized in a single stage turbine, i.e., one employing one rotor assembly only, wherein the blade retention features provided by the forward blade retainer and the thermal shield extending between the stage one and stage two assemblies is provided by blade retainers disposed on each side of the single stage rotor. The invention is therefore not limited to specific preferred embodiments as described, but is only limited as defined by the following claims.

What is claimed is:

1. A cooling system for use in a rotor assembly of a gas turbine engine, the rotor assembly including an annular disk rotatable about a centerline axis of the engine and a plurality of radially extending blades mounted on the disk, the disk including a plurality of circumferentially alternating posts and slots disposed about a periphery of the disk, each of the slots receiving a dovetail portion of one of the blades, said cooling system being effective for cooling each of the disk posts during operation of the engine, said cooling system comprising:

a plurality of seal bodies, each of said seal bodies forming a thermal isolation chamber positioned over a radially outer surface of one of the disk posts, wherein each of said seal bodies includes a cover plate;

a plurality of axially extending plenums, each of said plenums positioned inward of the dovetail portion of one of the blades, wherein said axially extending plenums receive cooling air during operation of the engine;

a first, annular retention member attached to the disk at a radially inner end thereof, said first retention member being effective for preventing egress of the blades from the disk slots in one axial direction, wherein a radially outer end of said first retention member is proximate a first axially facing surface of said cover plate;

a radially inner seal disposed in sealing engagement with said first retention member, the dovetail portion of each of the blades, and the disk posts; a radially outer seal disposed in sealing engagement with at least said first retention member and said cover plate of said seal bodies;

a recess formed in a second, opposite axially facing surface of said cover plate of each of said seal bodies, wherein each of said recesses receives cooling air from at least one of said plenums during operation of the engine, with the cooling air being diverted past said inner and outer seals into said recesses, wherein each of said recesses is also in fluid flow communication with one of said thermal isolation chambers.

2. The cooling system as recited in claim 1, further comprising:

a plurality of circumferentially spaced scallops formed in said first retention member; and wherein said first retention member comprises a blade retainer and wherein the number of said scallops is equal to the number of said recesses and wherein each of said scallops is in fluid flow communication with one of said recesses.

3. The cooling system as recited in claim 2, further comprising:

an aperture extending through said cover plate of each of said seal bodies; wherein each of said recesses comprises a radially extending recess; and wherein each of said apertures is in fluid flow communication with a corresponding one of said recesses and a generally radially aligned one of said scallops.

4. The cooling system as recited in claim 3, further comprising:

an annular channel which is bounded at an outer end by said outer seal, wherein said channel receives cooling air during operation of the engine and is in fluid flow communication with each of said scallops;

wherein each of said scallops is effective for diverting cooling air from said channel past said outer seal to a corresponding one of said apertures during operation of the engine.

5. The cooling system as recited in claim 4, further comprising:

a radially extending slot formed in an axially facing surface of the dovetail portion of each of the blades, said slots facing axially toward said blade retainer;

wherein each of said slots is in fluid flow communication with a corresponding one of said axially extending plenums and with said channel, each of said slots being effective for diverting cooling air from said corresponding one of said axially extending plenums past said inner seal to said channel during operation of the engine.

6. The cooling system as recited in claim 3, wherein:

each of said apertures comprises an enclosed slot extending axially through said cover plate.

7. The cooling system as recited in claim 3, wherein:

each of said apertures comprises an open slot extending axially through said cover plate and radially through a radially inner edge of said cover plate.

8. The cooling system as recited in claim 1, wherein said outer seal is disposed in sealing engagement with a radially inner edge of said cover plate.

9. The cooling system as recited in claim 1, wherein;

each of said seal bodies includes an axially extending connecting member attached to said cover plate and defining a corresponding one of said thermal isolation chambers;

wherein said cover plate is generally symmetrically disposed circumferentially about said connecting member.

10. The cooling system as recited in claim 5, wherein each of said scallops is disposed circumferentially between an adjacent pair of said slots in the dovetail portions of adjacent blades.

11. The cooling system as recited in claim 1, further comprising:

a cavity formed in an axially facing surface of the dovetail portion of each of the blades;

wherein a radially inner end of each of said cavities is disposed radially inward of said outer seal and a radially outer end of each of said cavities is disposed radially outward of said outer seal;

wherein each of said cavities is in fluid flow communication with one of said recesses.

12. The cooling system as recited in claim 11, wherein:

each of said recesses includes a first circumferentially extending entrance portion and a second radially extending exit portion;

said entrance portion of each of said recesses is in fluid flow communication with one of said cavities and said exit portion of each of said recesses is in fluid flow communication with said thermal isolation chamber of a corresponding one of said seal bodies.

13. The cooling system as recited in claim 12, further comprising:

a radially extending slot formed in an axially facing surface of the dovetail portion of each of the blades;

wherein each of said slots has an entrance disposed radially inward of said inner seal and in fluid flow communication with one of said axially extending plenums, and an exit disposed radially outward of said inner seal;

wherein said exit intersects and is in fluid flow communication with a radially aligned one of said cavities;

wherein each of said slots is effective for diverting cooling air from said corresponding one of said plenums past said inner seal to said radially aligned one of said cavities during operation of the engine;

wherein each of said cavities is effective for diverting cooling air from a radially aligned one of said slots past said outer seal to said circumferentially extending portion of one of said recesses during operation of the engine.

14. The cooling system as recited in claim 11, wherein:

each of said seal bodies further includes a connecting member attached to said cover plate and defining a corresponding one of said thermal isolation chambers;

said cover plate is asymmetrically disposed circumferentially about said connecting member.

15. The cooling system as recited in claim 1, wherein:

said outer seal is in sealing engagement with a first axially facing surface of said cover plate;

said recess comprises a radially extending recess formed in a second, opposite axially facing surface of said cover plate.

16. The cooling system as recited in claim 15, further comprising:

an annular plenum formed in part by said first retention member;

wherein each of said recesses has an entrance in fluid flow communication with said plenum;

said recesses are effective for diverting cooling air from said annular plenum past said outer seal to corresponding ones of said thermal isolation chambers during operation of the engine.

17. The cooling system as recited in claim 16, further comprising:

a radially extending slot formed in an axially facing surface of the dovetail portion of each of the blades, each of said slots being in fluid flow communication with one of said axially extending plenums;

wherein said inner seal is disposed radially inward of said annular plenum and said slots are effective for diverting cooling air from said axially extending plenums past said inner seal to said annular plenum during operation of the engine.

18. The cooling system as recited in claim 1, wherein:

said first retention member abuts a first axially facing surface of said cover plate of each of said seal bodies;

said radially extending recess is formed in a second, opposite axially facing surface of said cover plate.

19. The cooling system as recited in claim 18, wherein:

said cover plate comprises a forward cover plate;

said first retention member is disposed axially forward of the dovetail portions of the blades.

20. The cooling system as recited in claim 19, wherein said first retention member comprises a forward blade retainer.

21. The cooling system as recited in claim 19, wherein said first retention member comprises an aft portion of a thermal shield.

22. The cooling system as recited in claim 1, wherein each of the blades further includes a shank portion extending radially outward from the dovetail portion and a platform portion attached to an outer end of the shank portion, wherein:

each of said seal bodies is positioned in a cavity bounded by the radially outer surface of one of the disk posts, the shank portions of adjacent blades and the platform portions of the adjacent blades.

23. The cooling system as recited in claim 1, further comprising: a second annular retention member attached to the disk and effective for preventing egress of the blades from the disk slots in a second axial direction.

24. The cooling system as recited in claim 23, wherein:

said cover plate comprises a forward cover plate;

said first retention member comprises a forward blade retainer effective for preventing egress of the blades from the disk slots in an axially forward direction;

said second retention member prevents egress of the blades from the disk slots in an axially aft direction.

25. The cooling system as recited in claim 24, further comprising:

an annular plenum formed in part by said second retention member, said annular plenum in fluid flow communication with each of said axially extending plenums;

an aft seal disposed in sealing engagement with at least said second retention member and effective for inhibiting leakage of cooling air from said annular plenum in a radially outward direction;

wherein said inner seal comprises a forward inner seal and said outer seal comprises a forward outer seal.

26. The cooling system as recited in claim 25, wherein each of the disk posts and each of the blade dovetail portions includes a plurality of relief surfaces, wherein each blade dovetail portion relief surface is disposed adjacent one of the disk post relief surfaces, said cooling system further comprising;

a plurality of axially extending passages, each of said passages formed between one of the blade dovetail portion relief surfaces and an adjacent one of the disk post relief surfaces;

wherein said annular plenum is in fluid flow communication with at least radially inner ones of said passages.

27. The cooling system as recited in claim 26, wherein:

said aft seal is disposed radially outward of said forward inner seal;

at least one of said passages is in fluid flow communication with one of said recesses.

28. The cooling system as recited in claim 24, wherein:

said second retention member comprises a forward portion of a thermal shield.

* * * * *